US005927289A

United States Patent [19]

Joulia

[11] Patent Number: 5,927,289

[45] Date of Patent: Jul. 27, 1999

[54] APPLICATION UNIT FOR LIQUID OR VISCOUS PRODUCT USABLE IN COSMETICS, PAINTS OR GLUES

[75] Inventor: Gerard Joulia, Paris, France

[73] Assignee: L'Oreal, Paris, France

[21] Appl. No.: 08/955,620

[22] Filed: Oct. 22, 1997

[30] Foreign Application Priority Data

Oct. 22, 1996 [FR] France ..... 96 12833

[51] Int. Cl.[6] ..... A45D 29/11

[52] U.S. Cl. ..... 132/73; 132/317; 401/121

[58] Field of Search ..... 132/73, 317, 218; 401/122, 121; 220/695, 697, 698, 700, 702

[56] References Cited

U.S. PATENT DOCUMENTS

| | | | |
|---|---|---|---|
| 575,013 | 1/1897 | Taylor | 401/121 |
| 830,763 | 9/1906 | Bradbury | 401/121 |
| 1,533,705 | 9/1925 | Maxedon | 401/121 |
| 2,645,377 | 7/1953 | Bosley | 401/122 |
| 2,815,146 | 12/1957 | Silver . | |

FOREIGN PATENT DOCUMENTS 1557355 7/1969 Germany .

*Primary Examiner*—Todd E. Manahan

*Attorney, Agent, or Firm*—Oblon, Spivak, McClelland, Maier & Neustadt, P.C.

[57] ABSTRACT

An application unit for a product includes a reservoir (4) having a neck (10) delimiting an opening (15) obturated in a detachable manner by an obturating element (26). The neck comprises a wiper element (22) joined to the neck (10) by an elastically deformable connecting means (24), the wiper element (22) forming at least one ring portion (22, 40) having an edge (25) capable of permitting the wiping of an application element (30). The wiper element (22) is capable of pivoting from a first position wherein the ring portion is situated substantially inside the neck (10) under the constraint of the obturating element (26), to a second inclined position obtained during the withdrawal of the obturating element. The obturating element (26) is connected to the application element (30) by a stem (34) which, in the first position, is situated inside the ring portion so that during the withdrawal of the application element (30) by a movement substantially in the axis X of the neck opening, by pivoting from the first position to the second, the edge portion produces the wiping of the application element, and/or of the stem.

16 Claims, 2 Drawing Sheets

APPLICATION UNIT FOR LIQUID OR VISCOUS PRODUCT USABLE IN COSMETICS, PAINTS OR GLUES

BACKGROUND OF THE INVENTION

1. Field of the Invention

The invention relates to an application unit for a liquid or viscous product that can be used in particular in the field of cosmetics, paints or glues. In the field of cosmetics, the product may be a composition of nail varnish or a nail care composition, or a liquid lipstick.

2. Description of the Related Art

In general, an application unit for nail varnish comprises a varnish reservoir provided with an opening and an element for applying the varnish, such as a brush comprising a tuft of bristles fixed to a first end of a stem, the stem being secured at its other end in a cap serving as a gripping element intended to close the reservoir so that the tuft of bristles is immersed in this varnish when the application unit is closed.

To ensure a proper closure of the unit, the reservoir has a neck provided with a first thread that cooperates with a second thread provided in the cap. The neck is generally thick and flat, and fitted with a sealing ring. The stem is held in position in the cap by means of a support such as a sealing disk. This sealing disk is in contact with the sealing ring of the neck when the application unit is closed.

To apply the varnish to the nail, the user removes the brush, impregnated with the product, from the reservoir. Generally, the brush has an excess of the product. It is therefore necessary to eliminate this excess and, for this purpose, the user removes the excess by wiping the brush on the free end of the neck of the reservoir. Since the end of the neck is flat and thick, some of the product will remain on the neck and flow along its outer side and thus foul its thread. When the user again screws the cap down to close the reservoir, the product expands over the neck and into the thread. After the product on the cap-neck assembly has dried, it forms an accretion so that in subsequent use it is difficult or even impossible to unscrew the cap from the reservoir. Moreover, the product on the neck prevents proper sealing of the application unit because the sealing disk is no longer in leakproof contact with the sealing ring of the neck. Also, because of the bearing of the disk on the neck, it is no longer possible to take up the play between the neck and the bearing surface after the first use; this reduces the sealing effect still further.

It has been proposed, in GB-A-2 198 423, to dispose within the neck tongues which form a collar for wiping the brush. In FR-A-1530702 it has been proposed to arrange in the neck an annular channel provided with a central duct into which the brush may be inserted, the brush being wiped on the free end of the duct. However, these wiping devices are disposed in the neck and are bulky, however the currently used units for applying nail varnish the neck have an opening of a small diameter which cannot accommodate these wiping devices. While would be possible to increase the diameter of the neck, this would involve a modification of the form of the varnish bottles, making it necessary to also adapt the accessories such as the cap to the new dimensions of the neck.

U.S. Pat. No. 2,815,146 describes a pot intended to contain a liquid such as a paint, there being disposed in the opening of the pot a wiper element in the form of an annular ring which has a portion capable of emerging from the opening by resilience when the lid of the pot is lifted. Thus an application element such as a brush can be wiped on the ring, and fouling of the edge defining the opening of the pot is avoided. But the pot according to this patent is not designed to form a unit ready for use and does not include the closing element associated with an application element.

DE-A-15 57 355 describes a wiper device for bottles of nail varnish. In one embodiment, a wiper tube is elastically suspended in the neck of the bottle, the free end of the tube emerging from the neck in the open position. In the closed position, the neck pushes the tube into the inside of the neck by axial translation. The device has the drawback that, after extracting the brush, the user must again pass it into a position on the free end of the tube which is inclined relative to the axis of the tube. Easy wiping of the brush or of the stem of the brush cannot be ensured by this device. Indeed, to dry the brush it is necessary either to perform a movement distinct from the movement causing the withdrawal of the brush from the bottle, or to substantially modify the extracting movement so as to wipe the brush against the edge of the wiping means at the end of the travel.

SUMMARY OF THE INVENTION

It is an object of the present invention to remedy the abovementioned drawbacks.

It is another object of the present invention to provide an application unit which makes it possible to wipe the application element in a better way, while avoiding the fouling of the neck of the reservoir, which would inevitably lead to the cap sticking on the neck of the reservoir.

It is yet another object of the present invention to provide an application unit which makes it possible to effect the wiping of the application element, and optionally of its stern, in a single movement during their extraction from the reservoir.

It is yet another object of the present invention to provide an application unit which makes it possible to effect the wiping of the stem of the brush over substantially the whole of its length.

It is yet another object of the present invention to provide wiping means which are not bulky and are easily accommodated in the neck of the reservoir, while permitting the user to measure out the quantity of the product which he or she intends to apply.

According to the invention, it has unexpectedly and surprisingly been discovered that the above and other objects can be achieved by placing into the neck a ring whose upper edge makes it possible to wipe the applicator. Although intended especially for the packaging of nail varnish, the application unit of the invention may be suitable for the application of any other liquid or viscous product, and in particular paints, especially paints and inks for models and for drawings and glues.

According to a first aspect of the present invention, a unit for applying a liquid or viscous product comprising a reservoir having a neck with an axis delimiting an opening obturated in a detachable manner by an obturating element, the neck comprising a wiper element joined to the neck at at least one point by means of an elastically deformable connecting means, the wiper element forming at least one ring portion having an edge capable of permitting the wiping of an application element, the wiper element being capable by an elastic restoring movement of pivoting from a first position wherein the said ring portion is situated substantially inside the neck under the constraint of the obturating element, to a second inclined position obtained during the withdrawal of the obturating element and wherein at least one portion of the edge is brought substantially close to the axis of the neck.

According to the invention, the obturating element is connected to the application element by a stem which is situated in the first position inside the ring portion so that, during the withdrawal of the application element by a movement substantially within the axis of the neck by pivoting from the first position to the second position, the edge portion produces the wiping of the application element, and optionally of the stem.

During wiping on the edge of the ring, this wiper element permits the excess of the product removed from the application element to flow into the reservoir without fouling the neck. Besides, the ring is not bulky and, thanks to the flexible connecting means, can be accommodated in the opening of the neck without encumbering the neck. Furthermore, the arrangement of the ring allows the user to see and to control the wiping operation, and hence to measure out the quantity of the product which must remain on the application element after the wiping, in order to obtain a precise and impeccable application.

Advantageously in the second position, when the application unit in accordance with the invention is opened (that is to say, when the application element has been withdrawn from the reservoir and the wiper element is in its rest position), the wiper element is situated substantially in an inclined plane, so that an angle is formed between said plane and the normal of the axis of the neck, ranges from 10° C. to 60°, and preferably from 30° to 50°.

The elastically deformable connection can give a spring action to the wiper element; it then oscillates between a closed position and an open position. This elastic connection also permits automatic wiping of the application element charged with the product during the extraction of the application element from the neck. It should be noted that when the application element is withdrawn from the neck in one motion by a substantially axial movement, the wiping of the stem and of the application element are effected in such a way that it is not necessary to proceed with a wiping movement that is distinct from the extracting movement.

In accordance with the invention, the wiper element may be a ring or a ring portion. This shape makes it possible to obtain a wiper element which is of a small size and can be easily accommodated in the opening of the neck, while occupying little space.

According to a preferred embodiment of the invention, the neck is provided with an upper edge, and at least a portion of the wiper element is situated above the upper edge of the neck. The user will preferably wipe the application element on the highest portion of the wiper element, which makes the wiping operation easier and more precise, the highest portion being advantageously situated in the vicinity of the longitudinal axis of the unit. This arrangement permits easy wiping in good ergonomic conditions. In particular, the wiping operation is effected without any substantial modification of the movement of extracting the application element.

When the application unit is closed, that is to say when the application element is kept in position in the reservoir, the wiper element is situated in a plane perpendicular to the axis of symmetry of the reservoir.

Advantageously the wiper element may be connected, by the elastically deformable connecting means, to holding means fixed on the neck. It may, for example, comprise a tube force-fitted in the opening of the neck. According to another variant, the tubular holding means may be obtained by the winding of a rigid wire. In this case, the wiper element may be formed by a loop of the rigid wire in continuity with the winding forming the tube.

The means for holding the wiper element may have, on its upper portion, a flank intended to bear on the upper edge of the neck, thus ensuring proper fixing of the holding means and the wiper element in the opening of the neck.

The application element may be a brush, a foam, a quill, a flocked plastic material or a molded plastic material. When the application element is a brush, the brush is formed by a tuft of bristles, which can be made of any conventional form or material.

The application unit of the invention is perfectly suited for packaging nail varnish. Thus the invention also provides a unit for the application of nail varnish, comprising a reservoir having a neck and a gripping element carrying an application element immersed in the storage position in the product contained in the reservoir, the neck defining an opening of the reservoir, wherein the opening of the neck has a wiper element such as is defined above.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
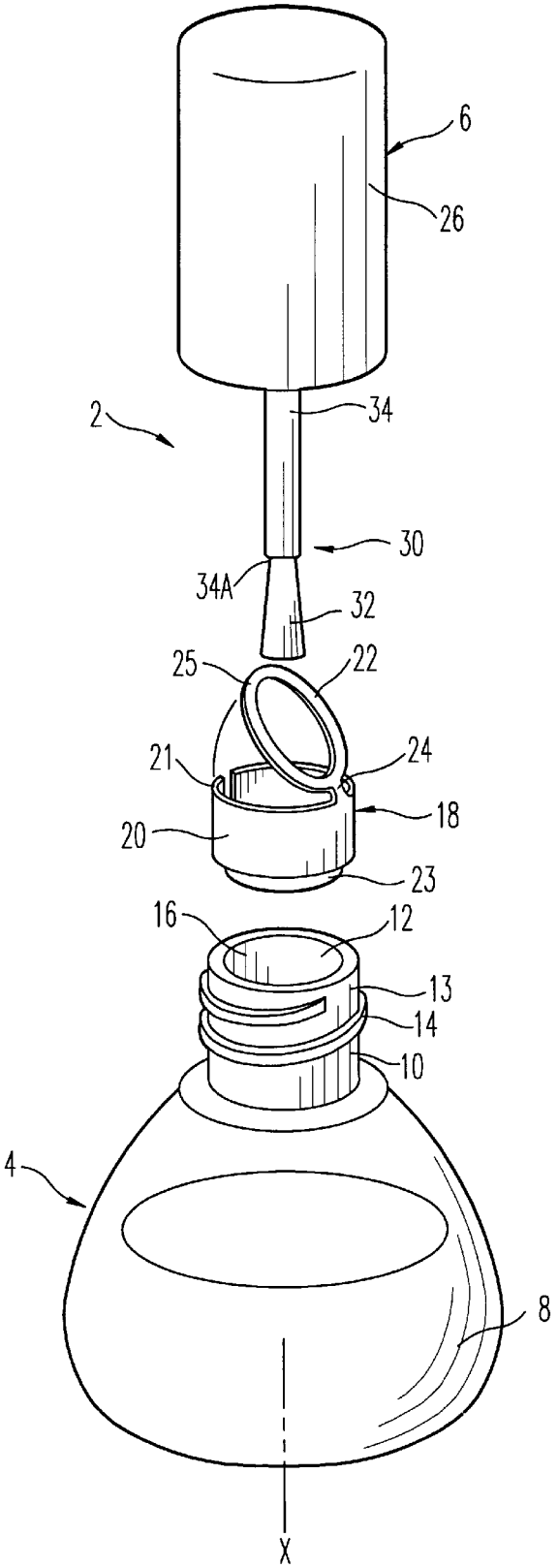
FIG. 1 is an exploded view of an application unit in accordance with a first variant of the invention.
Figure 2:
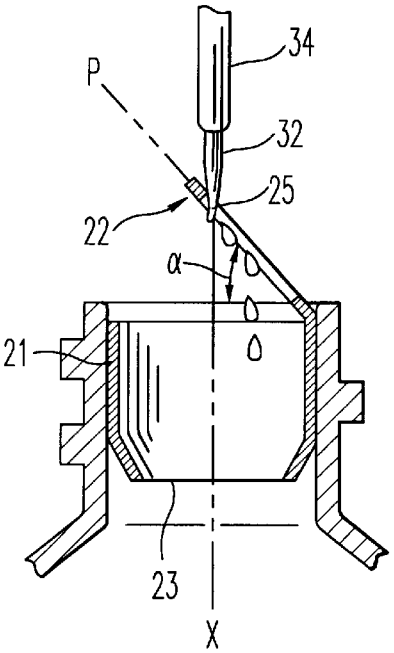
FIG. 2 is a partial axial view of the neck of the application unit of FIG. 1.
Figure 3:
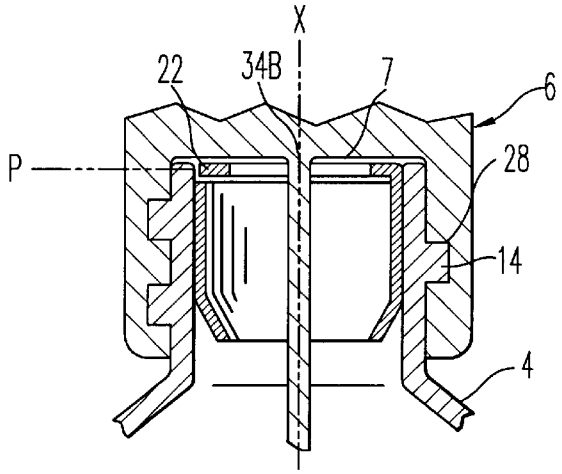
FIG. 3 is a partial axial view of the neck of the application unit of FIG. 1.

Referring to the attached FIGS. 1 to 3, an application element 2 includes a reservoir 4 having a longitudinal axis of symmetry X and a cap 6. The reservoir 4 contains a liquid or viscous product 8 to be applied, which may, for example, be a nail varnish composition. The reservoir is generally made of glass.

The reservoir 4 has a neck 10 provided with an internal face 12, an external face 13 having a thread 14 and an opening 16 which includes a wiper element 18. This element 18 has a cylindrical skirt 20 open at its two ends 21, 23, and a ring 22. The skirt 20 is force-fitted in the opening 16 of the neck 10. As may be better seen in FIG. 2, the ring 22 takes the form of a circular flat ring situated substantially in a plane P and has an upper edge 25. The upper edge 25 is connected to the upper end 21 of the skirt 20 by a tongue 24 forming a flexible, elastically deformable connecting means. The wiper element 18 is made from a single piece, in particular of a plastic material or metal.

The cap 6 has a cylindrical sleeve 26 serving as a gripping element whose internal side is provided with a thread 28 complementary to the thread 14 of the neck 10. The cap 6 also has an application element 30 which, in the present case, is a brush having a tuft of bristles 32 fixed to the free end 34*a* of a stem 34. The other end 34*b* of the stem is fixed to a bottom 7 in the cap 6.

When the application unit is closed, as may be seen in FIG. 3, the cap 6 is screwed onto the reservoir 4. The ring 22 is held in a closed position by the bottom 7 of the cap 6 in such a way that the plane P of the ring is substantially perpendicular to the axis X of the reservoir. The ring 22 is then entirely accommodated in the opening 16 of the neck 10 and does not project from the neck 10 when the application unit 2 is closed.

When the user wishes to apply the product 8, she unscrews the cap 6 and withdraws the brush 32 from the reservoir. Since the ring 23 is then released from contact with the bottom 7 of the cap, the flexible tongue 24 causes the ring 22 to pivot from the closed position to a position such that the plane P thereof is inclined at an angle $\alpha$ with the axis X, as may be seen in FIG. 2. The angle $\alpha$ may, for example, be equal to 40° for a neck 10 mm in diameter.

The brush 30 withdrawn from this reservoir has an excess of the product. To eliminate this excess, the user wipes the brush on the upper edge 25 of the ring 22, this edge being preferably situated in the vicinity of the axis X, and hence in the vicinity of the stem of the brush during its extraction. During this wiping operation, the brush remains substantially orientated along axis X, which is an advantage from the ergonomic point of view (see also FIG. 2). The eliminated excess product will then flow into the reservoir and does not flow along the outer side of the neck 10 to foul the thread 14. Moreover, the emergence of the ring 22 from the reservoir allows the user to see the wiping operation. The user can thus visually measure out the quantity of the product which remains on the brush after the wiping.

When the user has finished applying the product to the surface to be treated, she screws the cap 6 back onto the neck 10 of the reservoir. The ring 22 is then in contact with the bottom 7 of the cap 6 and pivots by flexure of the tongue 24 in such a way that when the cap 6 is screwed onto the neck 10, the plane P of the ring 22 is substantially perpendicular to the axis X. Thus, when the application unit 2 is closed, the ring 22 returns into the initial closed position it occupied before the use of the application unit 2.

Figure 4:
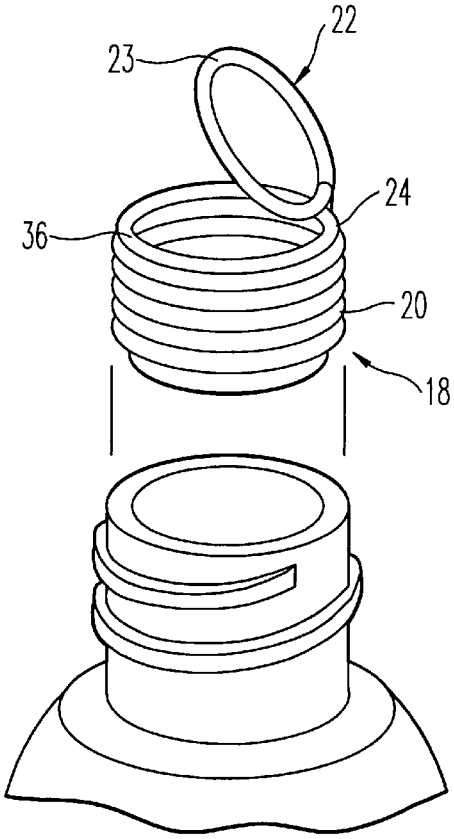
FIG. 4 is a partial exploded view of the neck of an application unit in accordance with a second variant of the invention.

FIG. 4 shows another embodiment of the wiper element in accordance with the invention, in which the skirt 20 of the wiper element 18 is formed by a cylindrical winding of a wire 36 made, for example, of a metal or plastic material. The ring 22 is formed in continuity with the winding by a turn 23 of the wire and is joined thereto by a small portion 24 of the wire, this portion forming a flexible and elastically deformable connecting means. The wiper element 18 functions in the same way as that described for the embodiment illustrated in FIGS. 1 to 3.

Figure 5:
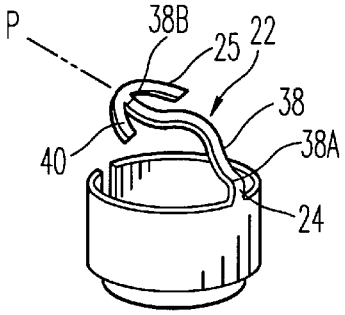
FIG. 5 is an elevational view of a wiper element in accordance with a third variant of the invention.
Figure 6:
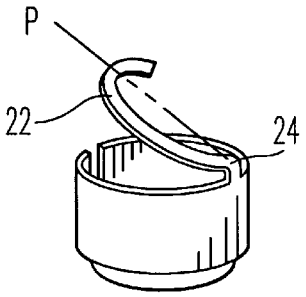
FIG. 6 is an elevational view of a wiper element in accordance with a fourth variant of the invention.

Referring to FIGS. 5 and 6, other variants of the embodiment of the wiper element of the application unit in accordance with the invention may be seen. The differences relate in essence to the shape of the wiper element. Thus the wiper element 22 of FIG. 5 includes a strip-like core 38, a first end 38*a* whereof is fixed to the flexible and elastically deformable tongue 24, the second end 38*b* having an arc 40 provided with an upper edge 25 allowing the brush to be wiped. The core 38 and the arc 40 are disposed substantially in the plane P. In FIG. 6, the wiper element 22 is formed by a portion of the ring of FIG. 1. This shape makes it possible to reduce the bulk of the wiper element in the opening of the neck. The wiper elements illustrated in FIGS. 5 and 6 function in the same way as that described in the embodiment illustrated in FIGS. 1 to 3.

Obviously, numerous modifications and variations of the present invention are possible in light of the above teachings. It is therefore to be understood that the invention may be practiced otherwise than as specifically described herein.

I claim:

1. An application unit for a liquid or viscous product, comprising:

a reservoir having a neck delimiting an opening;

an obturating element mountable to the neck for selectively closing said opening;

an application element removably insertable in said reservoir via said opening;

a wiper element mounted at the neck and forming at least one wiper portion having an edge capable of permitting wiping of the application element, the wiper portion being mounted for elastically pivotable movement from a first position wherein said wiper portion is situated substantially inside the neck when the obturating element is mounted to the neck, to a second position inclined from the first position when the obturating element is not mounted to the neck, wherein at least one portion of the edge is substantially on the axis of the opening when the wiper portion is in the second position so that the application element may be wiped by the edge portion in the second position during withdrawal of the application element from the reservoir by a movement substantially along the axis of the opening.

2. The application unit according to claim 1, wherein the wiper portion in the second position is situated substantially in a plane inclined at an angle $\alpha$ ranging from 10° to 60° with respect to the first position.

3. The application unit according to claim 2, wherein the angle $\alpha$ ranges from 30° to 50°.

4. The application unit according to claim 2, wherein, in the first position, the wiper portion is situated substantially in a plane perpendicular to the axis of the opening.

5. The application unit according to claim 1, wherein the wiper in the second position is situated above an upper edge of the neck.

6. The application unit according to claim 1, wherein said wiper element includes a wiper holder part mounted in the neck and an elastically deformable part elastically connecting the wiper portion to the wiper holder part so as to permit the wiper portion to elastically pivot from the first position to the second position.

7. The application unit according to claim 6, wherein the wiper holder part comprises a cylindrical part force fitted in the opening of the neck.

8. The application unit according to claim 7, wherein the cylindrical part is formed by wound wire, and wherein the wiper portion is formed by an extension of the wound wire.

9. The application unit according to claim 6, wherein the elastically deformable part comprises a tongue.

10. The application unit according to claim 9, wherein said wiper portion is in the form of a ring connected to said tongue.

11. The application unit according to claim 9, wherein said wiper portion is in the form of an arc connected to said tongue.

12. The application unit according to claim 9, wherein said wiper portion is in the form of a strip having one end connected to said tongue, and an arc connected to the other end of said strip, said edge being formed on said arc.

13. The application unit according to claim 1, wherein said wiper portion is in the form of a ring.

14. The application unit according to claim 1, wherein said wiper portion is in the form of an arc.

15. The application unit of claim 1, including nail varnish in said reservoir.

16. An plication unit for a liquid or viscous product, comprising;

a reservoir having a neck delimiting an opening;

an obturating element mountable to the neck for selectively closing said opening;

an application element removably insertable in said reservoir via said opening;

a wiper element mounted at the neck and forming at least one wiper portion having an edge capable of permitting wiping of the application element, the wiper portion being mounted for elastically pivotable movement from a first position wherein said wiper portion is situated substantially inside the neck when the obturating element is mounted to the neck, to a second position inclined from the first position when the obturating element is not mounted to the neck, wherein at least one portion of the edge is adjacent the axis of the opening when the wiper portion is in the second position so that the application element may be wiped by the edge portion in the second position during withdrawal of the application element from the reservoir by a movement substantially along the axis of the opening; and a stem having one end mounted to said obturating element, wherein the application element comprises a brush positioned at the other end of the stem, said stem being mounted to said obturating element such that when said obturating element is removed from the neck and said wiper element pivots to said second position, said application element is withdrawn from the reservoir opening and is wiped by said edge portion substantially along the axis of the opening.

* * * * *